US012409998B2

(12) United States Patent
Lombard

(10) Patent No.: US 12,409,998 B2
(45) Date of Patent: Sep. 9, 2025

(54) PACKAGING SYSTEM FOR AT LEAST ONE PRODUCT PREPARATION COMPONENT AND CORRESPONDING METHOD FOR HANDLING THE PRODUCT PREPARATION COMPONENT

(71) Applicant: Henkel AG & Co. KGaA, Duesseldorf (DE)

(72) Inventor: Antoine Lombard, Duesseldorf (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 385 days.

(21) Appl. No.: 17/481,287

(22) Filed: Sep. 21, 2021

(65) Prior Publication Data

US 2022/0002068 A1 Jan. 6, 2022

Related U.S. Application Data

(63) Continuation of application No. PCT/EP2020/055531, filed on Mar. 3, 2020.

(30) Foreign Application Priority Data

Mar. 21, 2019 (DE) ..... 102019203857 .3

(51) Int. Cl.
*B65D 81/32* (2006.01)
*B65D 41/04* (2006.01)
*B65D 51/28* (2006.01)

(52) U.S. Cl.
CPC ..... *B65D 81/3211* (2013.01); *B65D 41/04* (2013.01); *B65D 51/2871* (2013.01); *B65D 2251/0015* (2013.01); *B65D 2251/009* (2013.01)

(58) Field of Classification Search
CPC ..... B65D 81/32; B65D 81/3222; B65D 51/3216; B65D 25/08; B65D 81/326; B65D 81/3211; B65D 51/28
(Continued)

(56) References Cited

U.S. PATENT DOCUMENTS 4,102,451 A * 7/1978 Clarke ..... B65D 25/085 215/DIG. 8
4,903,828 A * 2/1990 Finke ..... B65D 81/3222 215/DIG. 8
(Continued)

FOREIGN PATENT DOCUMENTS

DE 29721872 U1 1/1998
EP 2327634 A1 6/2011
(Continued)

OTHER PUBLICATIONS

PCT International Search Report PCT/EP2020/055531 Completion Date: May 6, 2020; Mail Date: May 27, 2020 3 pages.
(Continued)

*Primary Examiner* — Anthony D Stashick
*Assistant Examiner* — Prince Pal
(74) *Attorney, Agent, or Firm* — Blank Rome LLP

(57) ABSTRACT

A packaging system for at least one product preparation component, having a first container for storing a first product preparation component, a second container for storing at least one further product preparation component, and a closure device which seals off an opening in the first container from the environment by way of a closure element having a coupling apparatus to couple the second container to the closure device and establishes a fluid connection between the first container and the second container. The invention additionally relates to a method for handling at least one product preparation component. The aim of the
(Continued)

invention is to ensure a reliable packaging system which allows a user-friendly handling of the contained product preparation components. The closure element and the coupling apparatus are joined together as separate components in a non-detachable manner forming the closure device.

17 Claims, 2 Drawing Sheets

(58) Field of Classification Search
USPC ..... 206/528, 219; 215/DIG. 8, 10
See application file for complete search history.

(56) References Cited

U.S. PATENT DOCUMENTS 5,170,888 A * 12/1992 Goncalves ..... B65D 81/3211 206/222
5,277,303 A * 1/1994 Goyet ..... B65D 81/3211 215/DIG. 8
5,419,445 A * 5/1995 Kaesemeyer ..... A61J 11/04 215/11.4
5,465,835 A * 11/1995 Schumacher ..... B65D 81/3222 215/DIG. 8
5,647,481 A * 7/1997 Hundertmark ..... B65D 81/3211 206/568
5,788,369 A * 8/1998 Tseng ..... A61J 9/00 215/11.2
5,944,175 A * 8/1999 Albisetti ..... B65D 81/3211 215/DIG. 8
D415,959 S * 11/1999 Antoine ..... D9/724
6,135,275 A * 10/2000 Kelders ..... B65D 81/3211 215/DIG. 8
6,244,433 B1 * 6/2001 Vieu ..... B65D 81/3211 222/129
6,293,395 B1 * 9/2001 Hof ..... B65D 81/3211 206/219
6,321,908 B1 * 11/2001 Lorscheidt ..... B65D 81/3211 215/DIG. 8
6,364,103 B1 * 4/2002 Sergio ..... B67B 7/28 141/330
7,337,921 B2 * 3/2008 Ma ..... B65D 51/285 426/112
7,607,460 B2 * 10/2009 Johns ..... B65D 81/3211 141/319
7,861,854 B2 * 1/2011 Sharon ..... B65D 51/2864 215/DIG. 8
8,151,985 B2 * 4/2012 Owoc ..... B65D 51/002 206/219
8,226,126 B2 * 7/2012 Johns ..... F16L 29/005 285/3
8,302,770 B2 * 11/2012 Valentine ..... B65D 51/2835 215/DIG. 8
8,459,450 B1 * 6/2013 Whitaker ..... A61J 9/00 215/11.4
8,511,465 B2 * 8/2013 Seelhofer ..... B65D 51/2821 426/112
8,640,865 B2 * 2/2014 Smart ..... B65D 51/2835 222/129
8,672,123 B1 * 3/2014 Vallejo ..... A61J 9/00 222/153.04
8,684,173 B2 * 4/2014 Otsuka ..... B65D 51/2864 215/DIG. 8
8,727,113 B2 * 5/2014 Robb ..... B65D 51/28 220/521
8,960,424 B1 * 2/2015 Anderson ..... B65D 51/2835 206/219
9,016,488 B1 * 4/2015 Peres ..... A61J 9/008 215/11.1
9,339,439 B2 * 5/2016 Nudo ..... B65D 81/3211
10,112,752 B2 * 10/2018 Tonn ..... B65D 47/06
10,238,803 B2 * 3/2019 Kumar ..... A61J 1/2093
10,414,563 B2 * 9/2019 Yang ..... B65D 85/72
10,723,537 B2 * 7/2020 Son ..... B65D 81/3222
11,247,834 B2 * 2/2022 Boulez ..... B65D 81/3205
11,279,545 B1 * 3/2022 Tarrant ..... A45D 34/00
11,465,806 B2 * 10/2022 Sitwell ..... B65D 43/0283
11,591,145 B2 * 2/2023 Kim ..... B65D 51/2878
2002/0030064 A1 * 3/2002 Lacout ..... B65D 81/3211 222/478
2003/0029827 A1 * 2/2003 Renz ..... A61J 9/001 215/11.1
2003/0030278 A1 * 2/2003 Shimei ..... B01L 3/563 285/331
2004/0112770 A1 * 6/2004 Oswald ..... B65D 51/2885 206/219
2004/0118709 A1 * 6/2004 Cho ..... B65D 51/2892 206/219
2004/0188371 A1 * 9/2004 Holley, Jr. ..... A61J 9/001 215/11.1
2004/0200742 A1 * 10/2004 Cho ..... B65D 51/2835 206/219
2005/0115845 A1 * 6/2005 Cho ..... B65D 51/2864 206/219
2005/0211579 A1 * 9/2005 Makita ..... B65D 51/2842 206/219
2005/0263414 A1 * 12/2005 Harilela ..... B05B 11/0081 206/219
2007/0017830 A1 * 1/2007 Neumeyer ..... B65D 51/2835 206/219
2007/0039975 A1 * 2/2007 Bochtler ..... B65D 71/502 222/61
2007/0119727 A1 * 5/2007 Cho ..... B65D 51/2892 206/217
2007/0221513 A1 * 9/2007 Taylor-Sharp ..... B65D 81/3211 222/129
2007/0280042 A1 * 12/2007 Yamanaka ..... B65D 51/2835 366/185
2007/0289670 A1 * 12/2007 Johns ..... B65D 81/3211 141/383
2008/0011624 A1 * 1/2008 Robb ..... B65D 81/3205 206/219
2009/0321286 A1 * 12/2009 Frutin ..... B65D 51/2892 206/219
2013/0306499 A1 * 11/2013 Lee ..... B65D 51/2864 206/221
2014/0110281 A1 * 4/2014 Chen ..... B65D 51/2892 206/219
2014/0361016 A1 * 12/2014 Moreau ..... B65D 51/28 426/115
2015/0027913 A1 * 1/2015 P. J. ..... B65D 81/3211 53/428
2015/0266634 A1 * 9/2015 Yang ..... B65D 51/2892 220/521
2015/0344204 A1 * 12/2015 Anderson ..... B65D 51/2871 222/83
2016/0317388 A1 * 11/2016 Bhargava ..... A61K 9/10
2017/0354289 A1 * 12/2017 Marina ..... A47J 31/407
2018/0009590 A1 * 1/2018 Wong ..... B65D 1/0246
2018/0118427 A1 * 5/2018 Lee ..... B65D 45/322
2018/0127171 A1 * 5/2018 Jung ..... B65D 51/28
2018/0133053 A1 * 5/2018 Gentile ..... B65D 47/18
2018/0134468 A1 * 5/2018 Gentile ..... B65D 81/3211
2020/0130906 A1 * 4/2020 McVaney ..... B65D 51/2864
2020/0361694 A1 * 11/2020 Lee ..... B01F 35/7161
2020/0391928 A1 * 12/2020 Willis ..... B65D 83/764
2021/0163195 A1 * 6/2021 Kim ..... B65D 51/2878
2022/0002065 A1 * 1/2022 Lombard ..... B65D 51/2814
2022/0002066 A1 * 1/2022 Lombard ..... B65D 81/3211
2022/0002067 A1 * 1/2022 Lombard ..... B65D 81/3211
2022/0002068 A1 * 1/2022 Lombard ..... B65D 41/04
2022/0024672 A1 * 1/2022 Xue ..... B65D 51/2892
2022/0081183 A1 * 3/2022 Tarrant ..... A45D 40/24
2022/0119175 A1 * 4/2022 Harris ..... B65D 41/04
2022/0258153 A1 * 8/2022 Caubet Canals ..... B01L 3/5635
2022/0388753 A1 * 12/2022 Jaramillo ..... B65D 81/3211

(56) References Cited

U.S. PATENT DOCUMENTS

FOREIGN PATENT DOCUMENTS

| | | | |
|---|---|---|---|
| EP | 2774874 | A1 | 9/2014 |
| JP | H05051734 | U | 7/1993 |
| JP | H06038810 | U | 5/1994 |
| JP | 2005014998 | A | 1/2005 |
| JP | 2012158361 | A | 8/2012 |
| JP | 2022526123 | A | 5/2022 |
| WO | 9851586 | A1 | 11/1998 |
| WO | 2007111667 | A2 | 10/2007 |
| WO | 2007145773 | A2 | 12/2007 |

OTHER PUBLICATIONS

Japan Patent Office, Notification of Reasons for Refusal, Patent application 2021-556416, Feb. 6, 2024, pp. 1-8, Patent Examination Division 2 Textile Packaging Machinery, Tokyo, Japan.

* cited by examiner

PACKAGING SYSTEM FOR AT LEAST ONE PRODUCT PREPARATION COMPONENT AND CORRESPONDING METHOD FOR HANDLING THE PRODUCT PREPARATION COMPONENT

FIELD OF THE INVENTION

The invention relates to a packaging system for at least one product preparation component, comprising a first container for storing a first product preparation component, a second container for optionally storing at least one further product preparation component, and a closure device which seals off an opening in the first container from the environment by means of a closure element and has a coupling apparatus in order to couple the second container to the closure device and in order to establish a fluid connection between the first container and the second container. The invention additionally relates to a corresponding method for handling the contained product preparation components. Such packaging systems have so far often been used for the targeted mixing of initially separately stored flowable product preparation components and are primarily used when using two-component or multi-component product preparations in which the individual preparation components are incompatible with one another due to their chemical composition or are chemically highly reactive and consequently should only be mixed shortly before the actual application. Such multi-component product preparations and application forms are known in principle from the cosmetic, medical, food and washing and cleaning agent sectors, among others.

BACKGROUND OF THE INVENTION

For example, German utility model DE 29721872 U1 describes an arrangement for coupling two containers with the aim of possible mixing of fluids initially stored separately in the containers. The coupling arrangement described therein is used, inter alia, to mix individual components of hair dyes, the individual components being incompatible with one another and therefore having to be stored separately from one another in separate containers until they are actually used. The individual components are mixed to form the ready-to-use hair dye directly before use. For this purpose, the coupling arrangement has two coupling elements, each of which allows a corresponding container to be attached. The coupling elements each form a flow passage which is in fluid connection with each container interior. In addition, the two flow passages are aligned with one another within the coupling arrangement. Furthermore, the coupling arrangement has a control element which is arranged displaceably between a first position and a second position in one of the flow passages. Depending on the position of the control element, the flow passages can be open or closed. Depending on the position of the control element, the flow passages are flowed through and thus the entire coupling arrangement is made possible or prevented. The flow passages are usually closed in the initial state of the coupling arrangement. To improve the sealing function, an additional plug is provided which closes a flow passage in the initial state of the coupling arrangement. During use, the plug is removed under the action of the displaceable control element such that the flow passages are opened to be flowed through.

WO 2007/111667 A2 describes a further system comprising two containers for separately storing two container contents, in which system the different container contents can be mixed directly before use by means of a coupling device connecting the two containers. For this purpose, the coupling device has a valve arrangement which can be moved between a closed position and an open position. In the open valve position, a flow passage which forms a fluid connection between the two containers is opened in the coupling device. Thus, when the valve is in the open position, the two container contents can be mixed.

Although the packaging systems described above allow separate storage of different substances and their mixing directly before the actual application in principle, they are functionally inadequate as far as the partitioned storage and efficient handling of the individual product preparation components are concerned. This is especially true when, for example, chemically highly reactive or possibly health-endangering substances are stored by means of a generic packaging system. In this respect, the aforementioned packaging systems are merely suitable for handling very specific chemical substances only.

Proceeding from this, the object of the invention is that of providing a closed packaging system for at least one product preparation component that allows reliable storage and handling of product preparation components of as many and different chemical substances as possible. In particular, reliable and user-friendly handling of chemically highly reactive or health-endangering substances should be made possible by means of the packaging system according to the invention.

BRIEF SUMMARY OF THE INVENTION

The object is achieved by a packaging system for at least one product preparation component. According thereto, the entire packaging system substantially comprises a first container for storing a first product preparation component, a second container for optionally storing at least one further product preparation component and a multi-functional closure device. This closure device is capable, inter alia, of sealing off an opening in the first container from the environment by means of a closure element in its initial state. In this way, above all, reactive chemical substances and health-endangering substances, for example, can be safely stored in the first container. By sealing the first container, substance constituents from the first container cannot enter the environment, and ambient conditions, for example air humidity or atmospheric oxygen, cannot negatively influence the substance constituents inside the first container due to chemical reactions. The closure device additionally has a coupling apparatus in order to detachably couple the second container to the closure device and as a result establish a fluid connection between the first container and the second container. Indeed, the closure device is designed in such a way that a fluid connection between the first container and second container, or in other words an opening in the first container, can only be achieved when the closure device is fully coupled to the second container by means of the coupling apparatus. In this way, the product preparation component is effectively prevented from being undesirably dispensed from the first container into the environment. In fact, the product preparation component can only be dispensed from the first container after it has been coupled to the second container. In this case, the closure element and the coupling apparatus are joined together as originally separate components in a non-detachable manner in order to form the closure device. In this way, the closure element and the coupling apparatus can be particularly easily produced in a suitable way independently of one another, for example by injection molding, and when in the assembled state, i.e. as the closure device, advantageously handled as a common structural unit. The closure element and the coupling apparatus can be joined together, for example, by means of a pressing process or a comparable joining step. In this case, the closure element and the coupling apparatus are axially pressed together under the action of force with respect to an axis of the closure device and are locked together in a substantially non-detachable manner. In this context, the non-detachable connection between the closure element and the coupling apparatus means that the two parts, once assembled, cannot be detached from one another again without being destroyed.

Furthermore, the closure element comprises a cap for closing the first container that is connected to the fastening sleeve of the closure element via a predetermined break point in the initial state of the closure device. In principle, the cap is designed in such a way that it can close or also open the opening in order to dispense the container contents from the first container. In the closed container state, the cap abuts the first container in such a way that the opening is completely covered and thus sealed off In order to open the first container, the cap must be released from said container at least to a sufficient extent. For this purpose, starting from the initial state of the closure device, the cap is separated from the fastening sleeve, which is non-detachably connected to the first container, in order to achieve an application state at the predetermined break point. After separation, the cap can be moved relative to the fastening sleeve or to the first container. Relative movement then also allows the cap to be released from the first container in order to open the container opening. The connection of the cap to the fastening sleeve via a predetermined break point thus forms a type of tamper-proof seal which advantageously signals the unused initial state of the first container comprising the closure device.

In principle, within the meaning of the present invention, the terms "product preparation" or "product preparation components" are understood to mean flowable and/or pourable substances. This includes all liquid, gel, pasty or similar high-viscosity substances which usually have corresponding flow properties, and all powder, particulate, granular or comparably solid-like substances which usually have corresponding flow or pouring properties. In this context, a "product preparation" or a "product preparation component" can each be composed of a single chemical substance and a mixture of substances.

According to an advantageous embodiment of the packaging system, the closure element, and thus the entire closure device, with the exception of when it has been destroyed, is non-detachably connected to the first container by means of a fastening sleeve. In this context, "non-detachable" means that the closure element and respectively the fastening sleeve cannot be detached from the first container without being destroyed. The non-detachable connection between the fastening sleeve and the first container is preferably created by latching or combined screwing/latching. In terms of joining technology, the fastening sleeve can be pressed against the first container in a particularly advantageous manner. Non-detachably connected in such a manner to the first container, the closure device stores the product preparation component within the first container in an extremely reliable and sealed manner. Therefore, a consumer cannot open the first container and the product preparation component cannot unintentionally escape from the first container into the environment. Likewise, the product preparation component stored in the first container is reliably protected from undesirable environmental influences, such as air humidity and/or atmospheric oxygen, as a result of the sealed container closure. Therefore, a packaging system of this kind also allows, inter alia, the storage and handling of chemically highly reactive and possibly health-endangering substances in the first container.

A "container" within the meaning of the present invention is understood to mean containers of a wide variety of shapes which have a common characteristic in that the interior of the container is surrounded by a container wall which encloses said container and has an opening for dispensing the container contents. The container opening in turn can be opened or closed by a suitable closure element. Such containers can therefore take on different forms. However, containers in the form of bottles, bags, canisters, crucibles, tubes or similar shapes appear particularly suitable. With regard to the material of the container, depending on the application-specific content, materials should be specifically selected which, due to their physical properties, initially ensure an adequate barrier effect against the environment, especially against atmospheric oxygen and moisture, in order to protect the container contents. In addition, the container material can be designed to be sufficiently inert with regard to its chemical-physical reactivity with the container contents.

With regard to the closure device and the choice of material therefor, similar framework conditions apply as for the container, i.e. with regard to the material, the closure device should preferably be designed in such a way that the closure device also has an adequate barrier effect, especially against atmospheric oxygen and moisture, and is also chemically inert to the container contents.

A useful design of the packaging system comprising a corresponding closure device can be achieved in that the cap is axially displaceable with respect to an axis of the closure device relative to the coupling apparatus and is arranged non-rotatably with respect to rotation about the axis. Here, the axis basically extends centrally through the substantially cylindrical or sleeve-shaped main structure of the closure device. The corresponding arrangement of the cap with respect to the closure device of course only applies to a limited extent for the initial state of the closure device, where the cap is preferably integrally connected to the fastening sleeve via the predetermined break point, i.e. in the initial state, the cap is fixedly connected to the fastening sleeve of the closure device such that said cap cannot be moved axially or rotationally relative to said sleeve. In addition, in the application state, i.e. after separation from the fastening sleeve, the cap is more specifically arranged axially and preferably so as to be rotatable in a limited manner relative to the fastening sleeve. Although the cap is arranged so that it can be axially displaced relative to the coupling apparatus continuously, i.e. both in the initial state and in the application state of the closure device, it cannot rotate in relation to said coupling apparatus. As a result of this specific arrangement, there is a very special interaction between the fastening sleeve, the cap and the coupling apparatus in the course of the coupling of the two containers that results from the movement of the individual components relative to one another. More specifically, the cap follows the rotational movement of the coupling apparatus due to the non-rotatable arrangement. As a result, the cap can also be separated from the fastening sleeve at the predetermined break point in the case of application, i.e. when rotating relative to the fastening sleeve. Even after the cap has been separated from the fastening sleeve, the cap follows the rotational movement, the cap then being movable axially both relative to the fastening sleeve and relative to the coupling apparatus.

A further embodiment of the packaging system results from the coupling apparatus having a thread for screwing on the second container. In this way, in the course of coupling, the coupling apparatus is screwed onto the second container by means of the interaction of corresponding threaded portions on the coupling apparatus and said second container. This allows a particularly user-friendly coupling of the two containers.

In an advantageous variant of the packaging system, the fastening sleeve and the coupling apparatus each have at least one mutually corresponding rotation stop element which allows the relative rotation of the fastening sleeve and the coupling apparatus about the axis of the closure device only as far as until the corresponding rotation stop elements abut one another. The mutually corresponding rotation stop elements on the fastening sleeve and the coupling apparatus fundamentally limit the relative rotation between the fastening sleeve and the coupling apparatus to a rotation range of almost 360°, i.e. almost one rotation. Each of the rotation elements are preferably designed as ribs, shoulders, protrusions or other comparable rotationally effective stop elements. Overall, the mutually corresponding rotation stop elements are used to allow the basic transmission of torque between the fastening sleeve and the coupling apparatus in the case of application, specifically when two corresponding rotation stop elements abut one another. The fastening sleeve and the coupling apparatus can be rotated relative to one another to a limited extent. Alternatively, it is also conceivable to design the rotation stop elements between the fastening sleeve and the coupling apparatus as locking elements which allow a relative rotation between the fastening sleeve and the coupling apparatus in one direction of rotation but prevent it in the opposite direction. Such locking elements can, for example, be designed as sawtooth-like profiles which, in mutual interaction, are similar to the operating principle of a tool ratchet or a bicycle freewheel. In principle, arrangements of this type allow torque transmission in only one direction of rotation.

According to a further developed embodiment of the packaging system, either the fastening sleeve or the coupling apparatus has at least two rotation stop elements which interact with the at least one corresponding rotation stop of the coupling apparatus or the fastening sleeve in such a way that a start and an end stop is formed for the relative rotation between the fastening sleeve and the coupling apparatus about the axis of the closure device. Continuing the variant having only one rotation stop element on the fastening sleeve and the coupling apparatus, the relative rotation between the two components is limited to an exactly defined range of rotation by arranging two rotation stop elements on at least the fastening sleeve or the coupling apparatus. The two rotation stop elements interacting with the at least one corresponding rotation stop element on exactly the other component form a start stop and an end stop for the relative rotation between the fastening sleeve and the coupling apparatus. In this way, the range of values for the relative rotation between the fastening sleeve and the coupling apparatus can be set exactly to an angle of rotation of less than 360°. These limited rotation angle ranges ultimately also determine the maximum possible amount of rotation of the cap relative to the first container. In this respect, the maximum opening dimension of the cap or the complete detachment of the cap from the first container is determined indirectly via this limited angle of rotation, i.e. at the end stop of the corresponding rotation stop elements, when the upper limit of the angle of rotation is reached, the cap is also fully detached from the first container. Thus, handling the packaging system during the container coupling can be simplified by appropriately setting the upper limit of the angle of rotation, since only a limited relative rotation between the individual components of the packaging system is necessary to fully couple the containers and to establish the fluid connection between them.

In a useful embodiment of the packaging system, the cap is connected to the first container via a thread which has a direction of rotation counter to the thread of the coupling apparatus. This embodiment offers the great application advantage that in the course of coupling the two containers by screwing the coupling apparatus on the second container, a constant direction of rotation can be maintained in order to ultimately produce the fluid connection between the first and second container. For example, a thread rotating to the right is provided between the coupling apparatus and the second container, while a thread rotating to the left is formed between the cap and the first container. It is thus possible, in the course of the coupling, to screw the first container comprising the closure device on the second container in a clockwise direction, i.e. rotating to the right, via the coupling apparatus. In this case the first container is rotated together with the closure device in a clockwise direction, i.e. rotating to the right, relative to the second container. If this relative rotation of the first and second container is continued in a clockwise direction, not only is the coupling completed, but the cap is also simultaneously separated from the fastening sleeve via the predetermined break point and the cap is detached from the first container due to the counter-rotating thread. The counter-rotating threads between the coupling apparatus and the second container and the cap and the first container bring about both the reliable coupling of the container and the setting of the fluid connection between the first and second container as a result of opening the first container in a very simple and also user-friendly way.

A preferred variant of the packaging system is characterized in that the cap thread has a high thread pitch in order to fully detach the cap from the first container by at most one rotation when said cap is rotated relative to said first container. In this way, it is ensured that only a limited relative rotation is required in order to fully detach the cap from the first container and thus to establish the fluid connection between the two containers. Ideally, this limited relative rotation between the two containers is in a range of less than one full rotation, i.e. a maximum of 360°.

In principle, the fluid connection between the two coupled containers allows the reliable and loss-free transfer of the product preparation component stored in the first container from the first to the second container via the corresponding opening in the first container and when the cap is detached. At least in the case of flowable and/or correspondingly pourable product preparation components, as described above, they are generally transferred as a result of gravity and therefore automatically by the first container being held on top. As an alternative or in addition, the transfer of the product preparation component can also be caused by means of an external force acting on a deformable first container. This applies, for example, to a bag or tube-like first container in which the product preparation component can be squeezed out of the first container in order to be transferred to the second container.

In an alternative embodiment of the packaging system, a further product preparation component is stored in the second container in order for the first product preparation component to be mixed with the at least one further product preparation component after the second container has been coupled to the first container by means of the closure device. For this purpose, the two product preparation components, which are initially stored separately from one another in the two containers, are initially brought together in the course of coupling the containers by forming the fluid connection in order for them to be subsequently mixed into a multi-component product preparation. The actual mixture is brought about by quickly moving the two coupled containers. For this purpose, the two coupled containers are shaken, swiveled, rotated or the like by the user. In principle, such multi-component product preparation mixtures consisting of individual product preparation components which are initially chemically incompatible with one another are not uncommon. Examples of such multi-component product preparation mixtures are cosmetic application products, such as multi-component hair coloring products. The advantage of the present packaging system lies in its main structure which is closed off from the environment, i.e. by means of the present packaging system, chemically highly reactive substances or health-endangering substances can also be safely handled as individual product preparation components. Finally, a first product preparation component can be transferred from the first container, optionally for subsequent mixing with a further product preparation component only if it has been coupled to a corresponding second container and the first container is opened as intended. Undesired leaking of the first product preparation component from the first container into the environment is effectively avoided by means of the present multi-functional closure device.

According to a further useful embodiment of the packaging system, the closure device can be coupled to the second container in a liquid-tight manner. According thereto, the closure device is so tightly coupled to the second container by means of the coupling apparatus that undesired leaking of one or more flowable and/or pourable product preparation components into the environment is reliably avoided. In this respect, a closed packaging system is achieved which reliably ensures that the user does not come into contact with one of the product preparation components being handled.

In a further developed variant of the packaging system, the closure device has at least one sealing element in order to ensure a liquid-tight connection to the first container and/or second container. Sealing elements of this type can in principle assume almost any geometric configuration and primarily have a sealing effect in the axial and/or radial direction. In particular, the sealing elements can be designed as a sealing ring, sealing lip or the like.

In addition, protection is sought for two alternative method instructions for handling at least one product preparation component using a packaging system described above.

A first alternative method is used for securely transferring at least one product preparation component from a first container into a second container, a packaging system as described above being used. According thereto, the packaging system comprises a first container for storing at least one first product preparation component, an opening in the first container being sealed off from the environment by means of a closure element of the closure device which is rigidly connected to the first container. For this purpose, the closure element comprises a cap which, in the initial state of the closure device, is connected to a fastening sleeve of the closure element via a predetermined break point. The first container, closed in this way, cannot be opened manually by the user. Furthermore, the closure device has a coupling apparatus in order to couple the second container to the closure device and in principle to be able to establish a fluid connection between the first container and the second container. In this case, the closure element and the coupling apparatus are joined together as initially separate components in a non-detachable manner in order to form the closure device. In this context, "non-detachable" means that the two components cannot be separated from one another again without being destroyed after the joining process. Furthermore, the coupling apparatus is axially displaceable with respect to an axis of the closure device relative to the closure device and is arranged non-rotatably with respect to rotation about the axis. In addition, the coupling apparatus has a thread for screwing on the second container. For such a packaging system, the following method sequence proves to be sensible for transferring the product preparation component from the first container into the second container without undesired leaking into the environment. Firstly, the first container is attached to the second container by means of the closure device, specifically by corresponding threads on the coupling apparatus and on the second container being brought into engagement. The closure device is then screwed onto the second container by means of the coupling apparatus, specifically as far as until a coupling end position between the coupling apparatus and the second container is reached. The coupling end position describes a state in which the coupling apparatus is fully screwed onto the second container by means of the thread. Moreover, the coupling apparatus cannot be screwed any further onto the second container and thus at least temporarily forms a fixed structural unit with the second container. This means that not only the closure device itself but also the first container, which is non-detachably connected to said device, is coupled to the second container. The relative rotation between the first container or the closure device and the second container that is already used for screwing on the closure device is then continued, i.e. the first container together with the closure element is rotated further relative to the second container while maintaining the untwisting direction of the coupling apparatus. In this case, the cap, which is initially connected to the fastening sleeve via the predetermined break point and is non-rotatably arranged relative to the coupling apparatus, is separated from the closure element or the fastening sleeve at the predetermined break point. The cap is separated at the predetermined break point due to the fact that during continued relative rotation between the two coupled containers, the fastening sleeve follows the movement of the first container, while the coupling apparatus with the cap follows the movement of the second container. After the cap has been separated from the fastening sleeve, the relative rotation between the first container or the fastening sleeve and the second container is continued with the coupling apparatus while maintaining the direction of rotation. The now-separated cap is connected to the first container by means of a thread which has a direction of rotation counter to the thread of the coupling apparatus. Thus, when the relative rotation is continued and as a result of the counter-rotating cap thread, the cap is simultaneously unscrewed from the first container. For example, the thread between the coupling apparatus and the second container is designed to rotate to the right, while the thread between the cap and the first container is designed to rotate to the left. Of course, the reverse direction of rotation of the two threads is also conceivable, it being crucial that the two threads be oriented in opposite directions to one another. As a result of the continued relative rotation, the cap is now unscrewed from the first container until it is fully detached from the container. In this fully detached state, the corresponding threaded portions of the cap and of the first container are no longer in engagement, and therefore the cap moves axially into the second container. This usually takes place as a result of gravity since the first container is usually arranged on top in the coupled state. Fully detaching the cap now causes a fluid connection between the first and the second container due to the immediate opening of the opening in the first container. After the fluid connection between the two containers has been set, the transfer of the at least one product preparation component from the first to the second container can then also take place. The product preparation component is preferably transferred as a result of gravity, the first container being arranged on top when the containers are coupled. In addition, the product transfer, especially in the case of a flexibly designed first container, can be supported by the action of external forces on the first container. This preferably applies to tube-shaped or bag-shaped first containers.

In principle, the procedure described above is suitable for handling almost all conceivable product preparation components. However, a particularly advantageous use occurs in connection with chemically highly reactive or also possibly health-endangering substances due to the closed mode of operation of the packaging system which has the possibility for transferring product only after proper coupling of the two corresponding containers. In addition, the procedure described above can be used extremely universally in a wide variety of fields of application. Purely by way of example, the advantageous use of the transfer method according to the invention may be mentioned here, inter alia, for any type of substance addition, for refilling processes from refill containers, for the addition of additives and for similar substance transfer processes.

A second alternative method is used not only to safely transfer at least one product preparation component from a first container into a second container, but also to subsequently mix the first product preparation component with a further product preparation component stored in the second container in order to form a multi-component product preparation. A packaging system as described above is also used here. According thereto, the packaging system comprises a first container for storing at least one first product preparation component, an opening in the first container being sealed off from the environment by means of a closure element of the closure device which is rigidly connected to the first container. For this purpose, the closure element comprises a cap which, in the initial state of the closure device, is connected to a fastening sleeve of the closure element via a predetermined break point. The first container, closed in this way, cannot be opened manually by the user. In addition, the packaging system comprises a second container for storing at least one further product preparation component. Furthermore, the closure device has a coupling apparatus in order to couple the second container to the closure device and in principle to be able to establish a fluid connection between the first container and the second container. In this case, the closure element and the coupling apparatus are joined together as initially separate components in a non-detachable manner in order to form the closure device. In this context, "non-detachable" means that the two components cannot be separated from one another again without being destroyed after the joining process. Furthermore, the coupling apparatus is axially displaceable with respect to an axis of the closure device relative to the closure device and is arranged non-rotatably with respect to rotation about the axis. In addition, the coupling apparatus has a thread for screwing on the second container. For such a packaging system, the following method sequence proves to be sensible for safely transferring the product preparation component from the first container into the second container without undesired leaking into the environment and for mixing said product preparation with the further product preparation component in order to form a multi-component preparation. Firstly, the first container is attached to the second container by means of the closure device, specifically by corresponding threads on the coupling apparatus and on the second container being brought into engagement. The closure device is then screwed onto the second container by means of the coupling apparatus, specifically as far as until a coupling end position between the coupling apparatus and the second container is reached. The coupling end position describes a state in which the coupling apparatus is fully screwed onto the second container by means of the thread. Moreover, the coupling apparatus cannot be screwed any further onto the second container and thus at least temporarily forms a fixed structural unit with the second container. This means that not only the closure device itself but also the first container, which is non-detachably connected to said device, is coupled to the second container. The relative rotation between the first container or the closure device and the second container that is already used for screwing on the closure device is then continued, i.e. the first container together with the closure element is rotated further relative to the second container while maintaining the untwisting direction of the coupling apparatus. In this case, the cap, which is initially connected to the fastening sleeve via the predetermined break point and is non-rotatably arranged relative to the coupling apparatus, is separated from the closure element or the fastening sleeve at the predetermined break point. The cap is separated at the predetermined break point due to the fact that during continued relative rotation between the two coupled containers, the fastening sleeve follows the movement of the first container, while the coupling apparatus with the cap follows the movement of the second container. After the cap has been separated from the fastening sleeve, the relative rotation between the first container or the fastening sleeve and the second container is continued with the coupling apparatus while maintaining the direction of rotation. The now-separated cap is connected to the first container by means of a thread which has a direction of rotation counter to the thread of the coupling apparatus. Thus, when the relative rotation is continued and as a result of the counter-rotating cap thread, the cap is simultaneously unscrewed from the first container. For example, the thread between the coupling apparatus and the second container is designed to rotate to the right, while the thread between the cap and the first container is designed to rotate to the left. Of course, the reverse direction of rotation of the two threads is also conceivable, it being crucial that the two threads be oriented in opposite directions to one another. As a result of the continued relative rotation, the cap is now unscrewed from the first container until it is fully detached from the container. In this fully detached state, the corresponding threaded portions of the cap and of the first container are no longer in engagement, and therefore the cap moves axially into the second container. This usually takes place as a result of gravity since the first container is usually arranged on top in the coupled state. Fully detaching the cap now causes a fluid connection between the first and the second container due to the immediate opening of the opening in the first container. After the fluid connection between the two containers has been set, the transfer of the at least one product preparation component from the first to the second container can then also take place. The product preparation component is preferably transferred as a result of gravity, the first container being arranged on top when the containers are coupled. In addition, the product transfer, especially in the case of a flexibly designed first container, can be supported by the action of external forces on the first container. This preferably applies to tube-shaped or bag-shaped first containers. After the first product preparation component has been transferred into the second container, the plurality of product preparation components can then be mixed in the second container in order to form a multi-component product preparation. Mixing is preferably carried out with an appropriately suitable movement of the two coupled containers, for example by means of shaking, swiveling, rotating or similar movements. In particular, the mixing process of the plurality of product preparation components is carried out under a continuous fluid connection between the two containers. This not only creates a very homogeneous mixture of the different product preparation components, but also ensures that the product preparation components are fully mixed in order to form the multi-component product preparation. This ensures that the stored quantities of the individual product preparation components actually flow fully into the multi-component product preparation mixture. In this respect, it is simultaneously guaranteed that by mixing the full quantities of product preparation components, a defined and therefore frequently intended mixing ratio between the individual product preparation components is also maintained.

Furthermore, within the context of this second alternative method, the specific design of the closed packaging system also ensures particularly safe handling of the individual product preparation components which are critical for the user. In principle, the above-described mixing process is suitable for handling a large number of different product preparation components to be further processed into a mixture. Above all, such a mixing method is useful for individual product preparation components which are chemically highly reactive with one another or with respect to environmental parameters and have to be kept separate from one another until they are actually used. Multi-component cosmetic products, such as hair coloring products, may be mentioned as an example of such application forms. Even substances which may be hazardous to health when considered individually can be advantageously and safely handled by means of the mixing method due to the closed design of the packaging system. In addition, the mixing method described above can be used extremely universally in a wide variety of fields of application.

According to a particularly advantageous development of the two aforementioned method alternatives, at least the method steps for coupling the two containers can be carried out reversibly. According thereto, when the relative direction of rotation which is used for coupling the two containers is reversed, the two containers can be decoupled again in an analogous manner in the reverse order of the corresponding individual method steps already described above. In principle, a reversal of the relative direction of rotation between the two coupled and fluidically connected containers leads to the coupling apparatus being unscrewed from the second container until the coupling apparatus can be fully detached from the second container. Such a reversible procedure opens up the possibility of repeating the coupling and decoupling process by means of the packaging system according to the invention as often as desired or, after decoupling, of continuing to handle the second container having the product preparation mixture in an application-related manner. Establishing the fluid connection between the containers is not reversible as a result of the complete detachment of the cap from the first container. This guarantees full use of the entire quantities of product preparation components from the two containers for generating the product preparation mixture. Last but not least, this ensures a defined mixing ratio between the individual product preparation components within the product preparation mixture. In any case, such a reversible sequence of the method steps mentioned for container coupling is possible both in a transfer method and in a mixing method.

A further useful design of the two alternative methods mentioned results in the relative rotation between the fastening sleeve and the coupling apparatus about the axis of the closure device being limited to a rotation range of less than 360° by mutually corresponding rotation stop elements being provided on the fastening sleeve and the coupling apparatus, which elements allow a relative rotation only between a start and an end stop position of the corresponding rotation stop elements. As already described, the two rotation stop elements interacting with the at least one corresponding rotation stop element on exactly the other component form a start stop and an end stop for the relative rotation between the fastening sleeve and the coupling apparatus. In this way, the range of values for the relative rotation between the fastening sleeve and the coupling apparatus can be set exactly to an angle of rotation of less than 360°. These limited rotation angle ranges ultimately also determine the maximum possible amount of rotation of the cap relative to the first container. In this respect, the maximum opening dimension of the cap or the complete detachment of the cap from the first container is determined indirectly via this limited angle of rotation, i.e. at the end stop of the corresponding rotation stop elements, when the upper limit of the angle of rotation is reached, the cap is also fully detached from the first container. In more detail, the thread between the cap and the first container is not only designed to be counter to the thread between the coupling apparatus and the second container in terms of its direction of rotation, but the thread pitch is also selected to be significantly higher than the thread between the coupling apparatus and the second container. Due to the high pitch of the thread between the cap and the first container, the cap makes sufficient axial travel despite the limited relative rotation to quickly detach the cap from the first container even with limited rotational movements and open the container opening. The optimized design of the thread pitch thus ultimately causes a sufficient axial opening or closing movement specifically within the start or end stop of the relative rotation between the closure element and the coupling apparatus.

BRIEF DESCRIPTION OF THE DRAWINGS

Further features of the invention are also explained below with reference to the embodiment shown in the figures, in which.

DETAILED DESCRIPTION OF THE INVENTION

Figure 1:
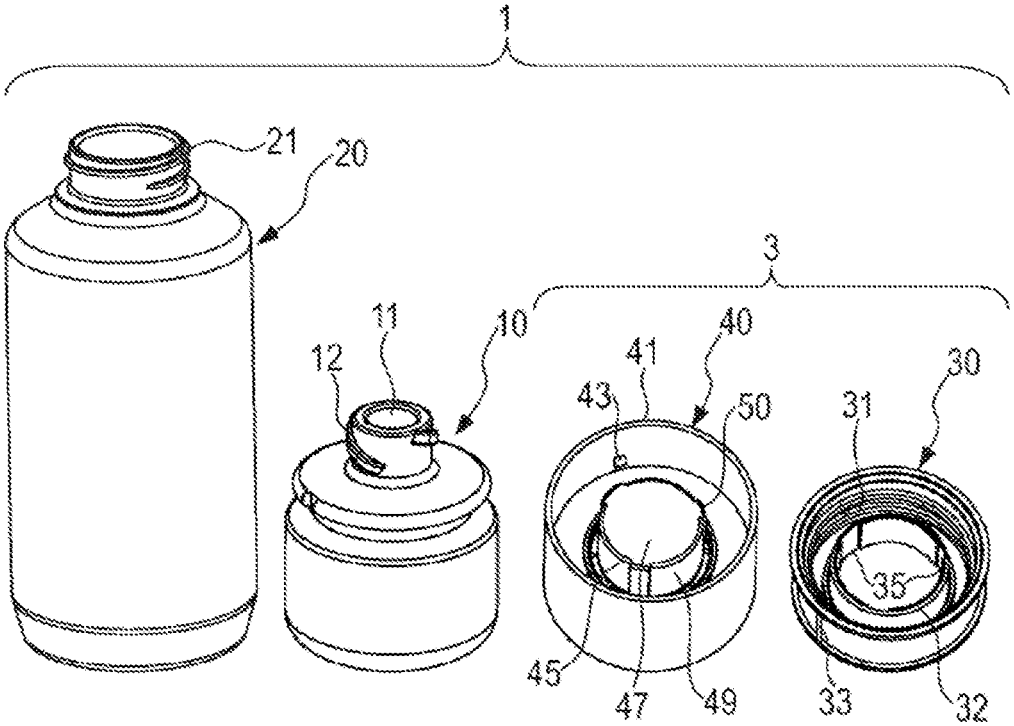
FIG. 1 shows an embodiment of the individual components of the packaging system in a perspective view.

The embodiment shown in FIGS. 1 to 4 illustrates a packaging system 1 comprising a first container 10 for storing a first product preparation component (not shown here) and a second container 20 for optionally storing at least one further, second product preparation component (also not shown here). The packaging system 1 shown is used for safely transferring the first product preparation component from the first container 10 to the second container 20 in a controlled manner. If there is a further, second product preparation component in the second container 20, the two product preparation components can also advantageously be mixed in order to form a multi-component product preparation.

In addition to the two containers 10, 20, the packaging system 1 also comprises a multi-functional closure device 3 which seals off the first container 10 from the environment in the initial state by means of a closure element 40. For reliable closure of the first container 10, the closure element 40 initially comprises a fastening sleeve 41 which is non-destructively non-detachably connected to the first container 10 in the ready-to-use state. For this purpose, the fastening sleeve 41 is preferably latched or screwed and latched in combination to the first container 10. In any case, the fastening sleeve 41, which is non-detachably connected to the first container 10, is fixed to the first container 10 in an axially and rotationally fixed manner with respect to an axis 4 of the closure device 3. In addition to the fastening sleeve 41, the closure element 40 has a substantially pot-shaped cap 45 which seals off an opening 11 in the first container 10 in the ready-to-use state. For this purpose, the cap 45 has a bottom wall 47 having an annular sealing plug 48 which is able to precisely close the opening 11 in the first container 10. This reliably prevents the first product preparation component from undesirably escaping from the first container 10 into the environment.

The closure device 3 also has a coupling apparatus 30 in order to couple the second container 20 to the closure device 3, and thus indirectly to the first container 10, and establish a fluid connection between the first container 10 and the second container 20 by the interposition of the closure device 3. For this purpose, the coupling apparatus 30 has an annular main structure having a thread 31 which is intended for engaging with a corresponding thread 21 on the second container 20. In addition, the coupling apparatus 30 also has an inner sleeve 32 which can interact with the cap 45 in an interlocking manner.

In principle, the two components, closure element 40 and coupling apparatus 30 of the closure device 3 are initially designed as separate components, which is advantageous in that they can be easily manufactured independently of one another, for example by means of injection molding. In the case of application, the closure element 40 and the coupling apparatus 30 are non-destructively non-detachably joined together in order to form the closure device 3. This is preferably done by means of a pressing connection, in which the closure element 40 and the coupling apparatus 30 are axially latched to one another. After latching, the closure element 40 and the coupling apparatus 30, as can also be seen in FIGS. 2 to 4 in particular, are non-detachably joined together in order to form the closure device 3 such that the closure device 3 can subsequently be handled very easily. At the same time, the closure element 40 and the coupling apparatus 30 are joined together within the closure device 3 in such a way that a limited relative rotation of the closure element 40 and the coupling apparatus 30 about the axis 4 is possible in principle. For this purpose, mutually corresponding rotation stop elements 33, 43 are provided on the closure element 40 and on the coupling apparatus 30, which elements, in corresponding interaction, limit the relative rotation between the closure element 40 and the coupling apparatus 30 to a rotation angle range of less than 360° in the case of application. This corresponds to a rotation range of less than a full rotation. In this case, the rotation stop elements 33, 43 are preferably designed as radial ribs or protrusions, but can also have any other suitable geometric design. According to a particularly preferred embodiment, a plurality of rotation stop elements 33, 43 can be distributed over the circumference of the closure element 40 and/or the coupling apparatus 30. As a result, the rotation angle range for the relative rotation between the closure element 40 and the coupling apparatus 30 can advantageously be limited further. The desired amount of permitted relative rotation between the closure element 40 and the coupling apparatus 30 can thus be set in a very targeted manner via the position of the rotation stop elements 33, 43 distributed around the circumference. Above all, the interaction of a plurality of rotation stop elements 33, 43 distributed around the circumference allows the defined fixing of start and end stop positions between the closure element 40 and the coupling apparatus 30, i.e. the defined relative rotation between the closure element 40 and the coupling apparatus 30 is limited to a determined, limited rotation angle range between the rotation start and rotation end stop. As an alternative to the limitation of the relative rotation illustrated by the embodiment, a relative rotation between the closure element 40 and the coupling apparatus 30 in only one direction of rotation can also be permitted. For this purpose, the rotation stop elements between the closure element 40 and the coupling apparatus 30 are designed as suitable locking elements which allow a relative rotation between the closure element 40 and the coupling apparatus 30 in one direction of rotation but prevent it in the opposite direction. Such locking elements can, for example, be designed as sawtooth-like profiles which, in mutual interaction, are comparable to the operating principle of a tool ratchet or a bicycle freewheel. In principle, arrangements of this type allow torque transmission in only one direction of rotation.

As already mentioned, in the initial state of the packaging system 1, the closure device 3 is non-detachably fastened to the first container 10 filled with the first product preparation component. Furthermore, in this initial state, as can be seen from FIG. 2, the closure element 40 and the coupling apparatus 30 are arranged with respect to one another in such a way that the cap 45 extends into the inner sleeve 32 of the coupling apparatus 30 in an interlocking manner. For this purpose, radially protruding projections 50 are formed on the circumferential wall 49 of the cap 45 that interact with corresponding recesses 35 of the inner sleeve 32 in an interlocking manner. As a result, the cap 45 is non-rotatably fixed on the coupling apparatus 30 with respect to a rotation about the closure device axis 4 such that the cap 45 follows every rotation of the coupling apparatus 30 about the axis 4.

Furthermore, the cap 45 has a substantially pot-shaped main structure, specifically having a bottom wall 47 which, in the initial state, covers the opening 11 of the first container 10, and a circumferential wall 49 extending about the axis 4. A plurality (in the present embodiment, three) radially projecting projections 50 are integrally formed on the outside of the circumferential wall 49. Furthermore, in the initial state, the cap 45 is integrally joined to the fastening sleeve 41 via a predetermined break point 52. In the present embodiment, the predetermined break point 52 comprises a plurality of point-shaped connecting projections which are distributed over the circumference of the cap and each extend between the fastening sleeve 41 and the circumferential wall 49 of the cap. Of course, other, alternatively suitable designs of the predetermined break point are also conceivable within the meaning of the invention.

To improve the sealing effect, the closure device 3 preferably comprises at least one sealing element 34, 48, 53, 54 which is effective within the closure device 3 itself or between the closure device and the first and/or second container 10, 20. In the embodiment of the closure device 3 shown in FIGS. 1 to 4, a plurality of sealing elements 34, 48, 53, 54 are provided which are preferably designed as sealing lips, sealing rings, annular sealing plugs or the like. These sealing elements 34, 48, 53, 54 in particular jointly prevent undesired leaking of a product preparation component from one of the containers 10, 20 into the environment and form a barrier to prevent surrounding influences such as atmospheric oxygen and humidity from having a negative effect on the product preparation components.

In general, such a substantially closed packaging system 1 can be used in a particularly versatile manner for storing and handling a wide variety of product preparation components or other chemical substances. In particular, the packaging system 1 allows the user to handle the product preparation components contained therein in a completely contact-free manner with regard to the container contents. Substantially, the packaging system 1 allows both user-friendly transferring of a first product preparation component from the first container 10 to a second container 20 and optionally subsequent mixing of the first product preparation component with a second further product preparation component originally contained in the second container 20. The two essential handling alternatives of the packaging system 1 are explained in more detail below, even if the embodiment of a packaging system 1 shown is preferably designed for mixing a multi-component product preparation.

Figure 3:
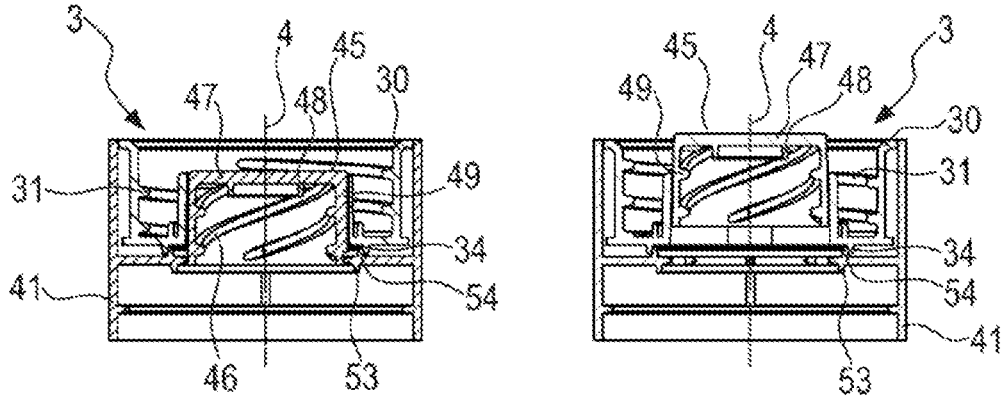
FIG. 3 shows the closure device according to FIG. 1 in two different operating states by means of two sectional views.

The process of the container coupling in order to handle the first product preparation component stored at least in the first container 10 is primarily illustrated with reference to FIGS. 3 to 4. To couple the two containers 10, 20, the first container 10 having the closure device 3 non-detachably fastened thereto is first placed in a position on top of the second container 20. This can be derived at least in principle from the left-hand drawing in FIG. 4. In this initial state, the cap 45 is screwed fully onto the first container 10 via the mutual threaded connection 12, 46 such that the opening 11 of the first container 10 is sealed off by means of the annular sealing plug 48. At the same time, the mutually corresponding threads 21, 31 on the second container 20 and on the coupling apparatus 30 are attached to one another. The first container 10 is then rotated together with the closure device 3 in a clockwise direction relative to the second container 20. In this case, the coupling apparatus 30 is screwed onto the corresponding thread 21 on the second container 20 via its thread 31 rotating to the right in the embodiment. In this stage, there is also no relative rotation between the closure element 40 and the coupling apparatus 30 since a relative rotation in this direction of rotation is prevented by corresponding interaction of corresponding rotation stop elements 33, 43. The relative rotation between the first container 10 or the closure device 3 and the second container 20 is continued until a coupling end position is reached which is shown in the left-hand drawing in FIG. 4. The coupling apparatus 30 is then completely screwed onto the second container 20 so that it is no longer possible to turn the coupling apparatus 30 clockwise and the coupling apparatus 30 forms a fixed structural unit together with the second container 20, at least at this stage. In this coupling end position, the coupling apparatus 30 thus follows the further movement of the second container 20 in the course of continuing the container coupling. After reaching the coupling end position in which the two containers 10, 20 are coupled to one another in principle but in which there is still no fluid connection between the containers 1, 20, the relative rotation already used to unscrew the closure device 3 is continued in the clockwise direction between the first container 10 or the closure device 3 and the second container 20, i.e. the first container 10 together with the closure element 40 is rotated further relative to the second container 20 while maintaining the untwisting direction to the right of the coupling apparatus 30. In the course of this continued rotational movement, the cap 45, which is initially connected to the fastening sleeve 41 via the predetermined break point 52 and is non-rotatably arranged relative to the coupling apparatus 30, is separated from the closure element 40 or the fastening sleeve 41 at the predetermined break point 52. The cap 45 is separated at the predetermined break point 52 due to the fact that during continued relative rotation between the two coupled containers 10, 20, the fastening sleeve 41 follows the rotational movement of the first container 10, while the coupling apparatus 30 with the cap 45 follows the rotational movement of the second container 20. When a defined torque threshold is exceeded, this leads to the predetermined break point 52 being broken. In this context, it should be noted that the torque required to break the predetermined break point 52 is in any case greater than the torque required to screw the coupling apparatus 30 onto the second container 20. This is the only way to maintain the desired sequence of the individual method steps when coupling the two containers 10, 20.

After the cap 45 has been separated from the fastening sleeve 41, the relative rotation between the first container 10 with the fastening sleeve 41 and the second container 20 with the coupling apparatus 30 is continued while maintaining the previous direction of rotation. The now-separated cap 45 is connected to a corresponding thread 12 on the first container 10 by means of a thread 46, the corresponding threads 12, 46 on the first container 10 and the cap 45 having a direction of rotation counter to the corresponding threads 21, 31 on the second container 20 or the coupling apparatus 30. Thus, the cap 45 is simultaneously unscrewed from the first container 10 when the relative rotation between the two containers 10, 20 is continued and as a result of the counter-rotating cap thread (see the middle drawing of FIG. 4). For example, mutually corresponding threads 21, 31 on the second container 20 and on the coupling apparatus 30 are designed to rotate to the right, while the corresponding threads 12, 46 on the first container 10 and the cap 45 are designed to rotate to the left. Of course, the reverse direction of rotation of each of the threads 21, 31, 12, 46 is also conceivable, it being crucial that the thread pairs 21, 31, 12, 46 associated with one another must be oriented in opposite directions to one another. As a result of the continued relative rotation, the cap 45 is now unscrewed at least far enough from the first container 10 that the corresponding threads 12, 46 on the cap 45 and on the first container 10 are no longer engaged and the cap 45 is consequently fully detached from the first container 10. At the same time, by fully detaching the cap 45, the opening 11 in the first container 10 is also opened such that a fluid connection is established between the first container 10 and the second container 20. The cap 45 is no longer held by the first container 10 and usually moves into the second container 20 due to gravity. This state in which the fluid connection is established between the containers 10, 20 is illustrated above all by the right-hand drawing in FIG. 4. After the fluid connection between the two containers 10, 20 has been set, the transfer of at least one product preparation component from the first container 10 to the second container 20 can then also take place. The flowable and/or pourable product preparation component (not shown here) is preferably transferred in this way as a result of gravity, the first container 10 being arranged on top when the containers are coupled. In addition, the product transfer, especially in the case of a flexibly designed first container 10, can be supported by the action of external forces on the first container 10. This preferably applies to tube-shaped or bag-shaped first containers 10.

Figure 2:
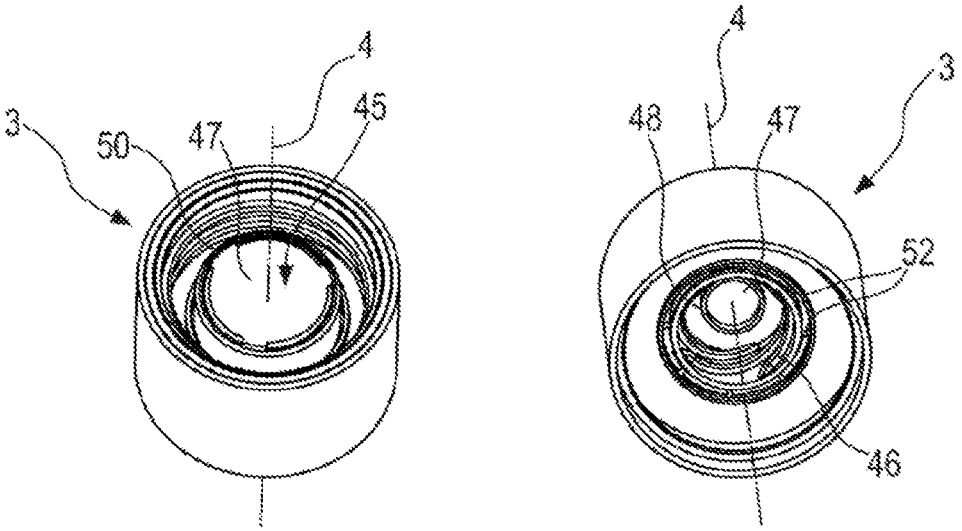
FIG. 2 shows the closure device according to FIG. 1 in two perspective views.

The above-described procedure for handling the packaging system 1 according to the invention also reveals its decisive advantage. Due to the closed structure of the packaging system 1 in relation to the environment, safe handling of the product preparation components contained in the containers 10, 20 can be guaranteed under all circumstances. Manual removal of the contents from the first container 10 alone is not possible due to the non-destructively non-detachably fastened closure device 3. Rather, in the initial state of the first container 10, the cap 45, as can be seen in FIG. 2, is protected against manual access from the outside by its interlocking embedding in the inner sleeve 32 of the coupling apparatus 30. Consequently, the cap 45 cannot be detached from the first container 10 without the interaction of the closure device 3 having the corresponding second container 20. The cap 45 is only detached from the opening 11 of the first container 10 in the case of a coupling with the corresponding second container 20 due to the interaction described above. A fluid connection of the first container 10 is thus limited exclusively to the second container 20 which matches it. An undesired fluid connection between the first container 10 and the environment is precluded by the specific design of the packaging system. The packaging system 1 is thus not only advantageously tamper-proof, but also brings about the transfer of the product preparation components only within the closed packaging system 1. In this way, for example, undesirable spillage of substances during the transfer from one container to another can be avoided. Ultimately, the closed packaging system 1 prevents any contact between the user and the product preparation components contained therein in every state of application.

The procedure described above for coupling the two containers 10, 20 and for establishing a fluid connection between the containers 10, 20 by opening the cap 45 cannot be used solely for transferring a first product preparation component from the first container 10 to the second container 20. Alternatively, it is conceivable to also use the packaging system described above for mixing a multi-component product preparation. For this purpose, a first product preparation component is initially stored in the first container 10, while at least one further product preparation component is stored in the second container 20. In the initial state, the second container 20 is preferably closed off from the environment by a removable closure (not shown here). If the two containers 10, 20 are now coupled to one another according to the procedure explained above and the corresponding fluid connection is established, the first and the further product preparation component can generally be brought together in the second container 20. The first product preparation component is transferred from the first 10 to the second container 20 as described. The two product preparation components can then be mixed with one another within the coupled and fluidically connected containers 10, 20. For this purpose, the entire packaging system 1 comprising the coupled containers 10, 20 is preferably shaken, swiveled or similarly moved in order to mix the two product preparation components into a multi-component product preparation which is as homogeneous as possible through the dynamic of movement. Ideally, the fluid connection between the containers 10, 20 is maintained during the mixing process, which increases the available mixing space and ensures that both product preparation components are used in their full amount for the production of the product preparation mixture.

Figure 4:
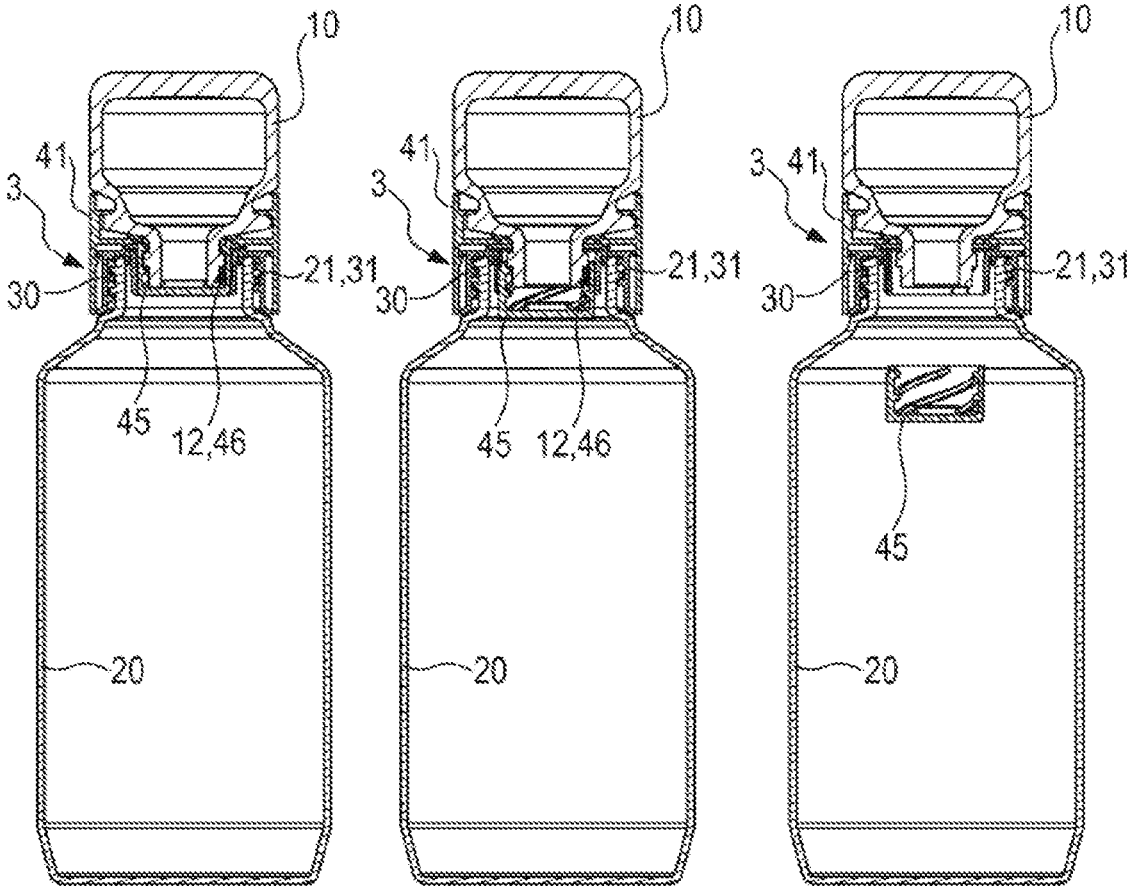
FIG. 4 shows the packaging system according to FIG. 1 in three different operating states by means of three sectional views.

When the packaging system 1 is in use with the containers 10, 20 coupled and the fluid connection set up between the containers, as shown in the right-hand drawing in FIG. 4, it can also be seen that the cap 45 is fully detached from the first container 10. The cap 45 is therefore no longer in any connection with the first container 10 and has meanwhile moved into the second container 20. According thereto, when the first relative direction of rotation which is used to couple the two containers 10, 20 is reversed, the two containers 10, 20 can be decoupled again in an analogous manner in the reverse order of the corresponding individual method steps already described above. In principle, a reversal of the relative direction of rotation between the two coupled and fluidically connected containers 10, 20 leads to the coupling apparatus 30 being unscrewed from the second container 20 until the coupling apparatus 30 can be fully detached from the second container 20. Such a reversible procedure opens up the possibility of repeating the coupling and decoupling process by means of the packaging system 1 according to the invention as often as desired or, after decoupling, of continuing to handle the second container 20 having the product preparation mixture in an application-related manner. Establishing the fluid connection between the containers is not reversible as a result of the complete detachment of the cap 45 from the first container 10. This guarantees full use of the entire quantities of product preparation components from the two containers for generating the product preparation mixture. Last but not least, this ensures a defined mixing ratio between the individual product preparation components within the product preparation mixture. In any case, such a reversible sequence of the method steps mentioned for container coupling is possible both in a transfer method and in a mixing method.

In principle, the procedure described above is suitable for handling almost all conceivable flowable and/or pourable product preparation components within the meaning according to the invention. However, a particularly advantageous use occurs in connection with chemically highly reactive substances or substances which may be hazardous to health when considered individually due to the closed mode of operation of the packaging system 1 which has the possibility for transferring product only after proper coupling of the two corresponding containers 10, 20. In addition, the procedure described above can be used extremely universally in a wide variety of fields of application. Purely by way of example, the advantageous use of the transfer method according to the invention may be mentioned here, inter alia, for any type of substance addition, for refilling processes from refill containers, for the addition of additives and for similar substance transfer processes.

Furthermore, the specific design of the closed packaging system 1 also ensures particularly safe handling of the individual product preparation components which are critical for the user in the case of the production of a multi-component product preparation mixture. In principle, the above-described mixing process is suitable for handling a large number of different product preparation components which can be further processed into a mixture. Above all, such a mixing method is useful for individual product preparation components which are chemically highly reactive with one another and must be stored separately from one another until they are actually used. Multi-component cosmetic products, such as hair coloring products, may be mentioned as an example of such application forms. Even substances which may be hazardous to health when considered individually can be advantageously and safely handled by means of the mixing method due to the closed design of the packaging system. In addition, the mixing method described above can be used extremely universally in a wide variety of fields of application.

REFERENCE NUMERALS

1 packaging system
3 closure device
4 axis
10 first container
11 opening
12 thread
20 second container
21 thread
30 coupling apparatus
31 thread
32 inner sleeve
33 rotation stop element
34 sealing element
35 recess
40 closure element
41 fastening sleeve
43 rotation stop element
45 cap
46 thread
47 bottom wall
48 sealing plug
49 circumferential wall
50 projection
52 predetermined break point
53 sealing element
54 sealing element

What is claimed is:

1. A packaging system, comprising:

a first container configured to store a first product preparation component;

a second container; and a closure device comprising a coupling apparatus connected to a closure element that comprises a fastening sleeve and a closure cap, the closure element being configured to couple to the first container such that the closure cap seals an opening in the first container, the coupling apparatus being configured to couple to the second container, and the closure device being configured to establish a fluid connection between the first container and the second container when the closure cap is separated from the fastening sleeve and detached from the first container, wherein (1) axial movement of the coupling apparatus relative to the closure element is prevented, (2) rotation of the coupling apparatus relative to the closure cap is prevented, and (3) rotation of the coupling apparatus relative to the fastening sleeve is permitted for at most one rotation, and wherein the closure cap is configured to be completely separated from the fastening sleeve along a predetermined break point while the fastening sleeve is connected to the first container.

2. The packaging system of claim 1, wherein the fastening sleeve is non-detachably connected to the first container.

3. The packaging system of claim 1, wherein the coupling apparatus comprises a thread configured to be screwed on the second container.

4. The packaging system of claim 1, wherein the fastening sleeve and the coupling apparatus each have at least one mutually corresponding rotation stop element to permit the at most one rotation between the fastening sleeve and the coupling apparatus.

5. The packaging system of claim 3, wherein the closure cap comprises a thread configured to be screwed on the first container via a direction of rotation counter to a direction of rotation of the thread of the coupling apparatus.

6. The packaging system of claim 1, wherein the closure device is configured to be coupled to the first container and to the second container in a liquid-tight manner.

7. The packaging system of claim 1, wherein the closure device comprises at least one seal configured to ensure a liquid-tight connection to the first container and/or the second container.

8. A method for transferring at least one product preparation component from a first container into a second container using the packaging system of claim 1, the method comprising:

coupling the closure element to the first container and the coupling apparatus to the second container;

causing relative rotation between the first container or the closure element and the second container until the closure cap is entirely, separated from the fastening sleeve at the predetermined break point;

causing further relative rotation between the first container or the closure element and the second container until the closure cap is unscrewed from the first container, thereby forming a fluid connection between the first container and the second container when the detached closure cap moves into the second container; and transferring the first product preparation component from the first container into the second container.

9. The method of claim 8, wherein the second container is configured to store a second product preparation component, and the method further comprises:

mixing the first product preparation component and the second product preparation component in the first container and/or in the second container.

10. The method of claim 8, further comprising decoupling the closure element from the second container after transferring the first product preparation component from the first container into the second container.

11. The packaging system of claim 1, wherein the second container is configured to store a second product preparation component.

12. The packaging system of claim 1, wherein the predetermined break point comprises a plurality of point-shaped connecting projections extending at least partially between the fastening sleeve and the closure cap.

13. The packaging system of claim 1, wherein the predetermined breaking point is circumferentially around the closure cap.

14. The packaging system of claim 1, wherein the closure cap is configured to fall into the second container when the closure cap is completely separated from the fastening sleeve and detached from the first container.

15. The packaging system of claim 1, wherein the closure cap has projections and an inner surface of the coupling apparatus has grooves that interact with the projections to prevent rotation of the coupling apparatus relative to the closure cap.

16. The packaging system of claim 1, wherein the axial movement of the coupling apparatus relative to the closure element is prevented via a pressing connection.

17. The packaging system of claim 5, wherein the thread of the closure cap fully detaches the closure cap from the first container by at most one rotation when the closure cap is rotated relative to the first container.

* * * * *